United States Patent [19]

Dimier

[11] Patent Number: 4,763,908

[45] Date of Patent: Aug. 16, 1988

[54] SAFETY SKI BINDING

[75] Inventor: Jean-Pierre Dimier, Rumilly, France

[73] Assignee: Salomon S.A., Annecy Cedex, France

[21] Appl. No.: 766,201

[22] Filed: Aug. 16, 1985

[30] Foreign Application Priority Data

Aug. 17, 1984 [FR] France ..... 84 12909

[51] Int. Cl.[4] ..... A63C 9/08

[52] U.S. Cl. ..... 280/628; 280/629; 280/633; 280/634

[58] Field of Search ..... 280/626, 628, 629, 636, 280/633, 607, 625, 618

[56] References Cited

U.S. PATENT DOCUMENTS

| | | | |
|---|---|---|---|
| 3,000,644 | 9/1961 | Beyl . | |
| 3,194,574 | 7/1965 | Beyl | 280/625 |
| 3,638,959 | 2/1972 | Reuge | 280/625 |
| 3,942,809 | 3/1976 | Sittmann . | |
| 4,170,372 | 10/1979 | Salomon . | |
| 4,260,175 | 4/1981 | Salomon . | |
| 4,336,956 | 6/1982 | Richert et al. . | |
| 4,337,965 | 7/1982 | Salomon . | |
| 4,345,776 | 8/1982 | Salomon | 280/629 |
| 4,362,313 | 12/1982 | Andrieu et al. | 280/628 |
| 4,398,747 | 8/1983 | Bernard et al. . | |
| 4,401,318 | 8/1983 | Beyl . | |
| 4,405,153 | 9/1983 | Salomon . | |
| 4,457,533 | 7/1984 | Salomon | 280/628 |
| 4,494,769 | 1/1985 | Beyl et al. . | |
| 4,538,828 | 9/1985 | Dimier . | |
| 4,561,673 | 12/1985 | Pascal et al. . | |
| 4,577,887 | 3/1986 | Bardin et al. | 280/628 |

FOREIGN PATENT DOCUMENTS

| | | | |
|---|---|---|---|
| 0025747 | 3/1981 | European Pat. Off. . | |
| 0030175 | 6/1981 | European Pat. Off. . | |
| 754109 | 5/1943 | Fed. Rep. of Germany . | |
| 2030749 | 12/1971 | Fed. Rep. of Germany . | |
| 2950777 | 7/1980 | Fed. Rep. of Germany | 280/625 |
| 2905837 | 8/1980 | Fed. Rep. of Germany . | |
| 2948274 | 6/1981 | Fed. Rep. of Germany . | |
| 3421499 | 12/1984 | Fed. Rep. of Germany . | |
| 1363895 | 9/1962 | France . | |
| 1438299 | 4/1966 | France | 280/629 |
| 2248680 | 5/1975 | France . | |
| 2258876 | 8/1975 | France . | |
| 2263796 | 10/1975 | France . | |
| 2419737 | 10/1979 | France . | |
| 2420359 | 10/1979 | France . | |
| 2458299 | 1/1981 | France . | |
| 2463629 | 2/1981 | France . | |
| 2469189 | 5/1981 | France . | |
| 2478476 | 9/1981 | France . | |
| 2523837 | 9/1983 | France . | |
| 2523857 | 9/1983 | France . | |
| 2517214 | 3/1984 | France . | |
| 2537442 | 6/1984 | France | 280/631 |
| 8220852 | 7/1984 | France . | |
| 2547508 | 12/1984 | France | 280/618 |
| 8319397 | 6/1985 | France | 280/618 |
| 8400346 | 7/1985 | France . | |
| 8403664 | 9/1985 | France . | |
| 2560777 | 9/1985 | France | 280/618 |
| 8412910 | 8/1986 | France . | |
| 1208385 | 1/1985 | Japan . | |

*Primary Examiner*—David M. Mitchell

*Attorney, Agent, or Firm*—Sandler & Greenblum

[57] ABSTRACT

A ski binding adapted to releasably hold the front of a ski boot on a ski. The front of the boot includes front-end zone spaced from the lateral edges of the boot. The binding includes a jaw, a support, and a support zone on the jaw. The jaw is adapted to hold the front of the boot and adapted to laterally pivot in response to pivoting of the boot. The support, which is mounted on the ski, includes two upwardly converging lines of support which converge at a convergence point. The jaw is adapted to laterally pivot around either one of these upwardly converging lines of support. The support zone which is positioned on the jaw supports the front-end zone of the boot when the boot is held by the jaw. The median vertical height of the support zone is substantially at the same vertical height as the convergence point. As a result, when the boot experiences a torsional force and a frontward force on the boot, the boot laterally pivots and the pressure of the front of the boot against the support zone does not substantially increase the torque of the boot in the direction in which the boot is already pivoting due to the torsional force.

5 Claims, 4 Drawing Sheets

FIG. 5.
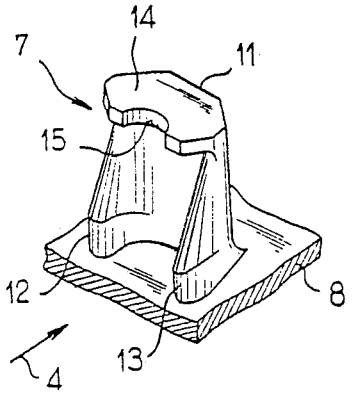
FIG. 6.
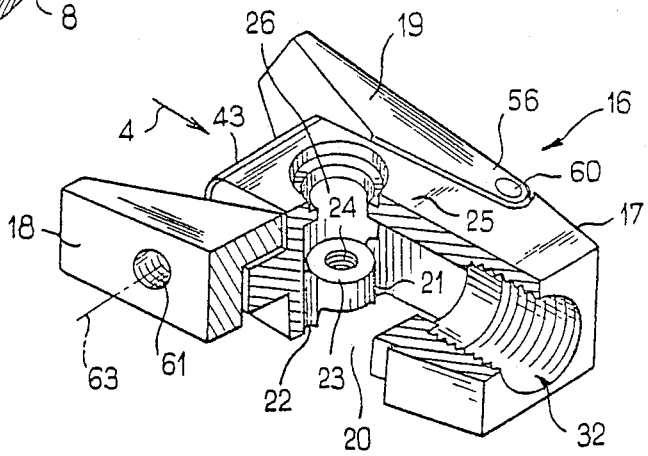
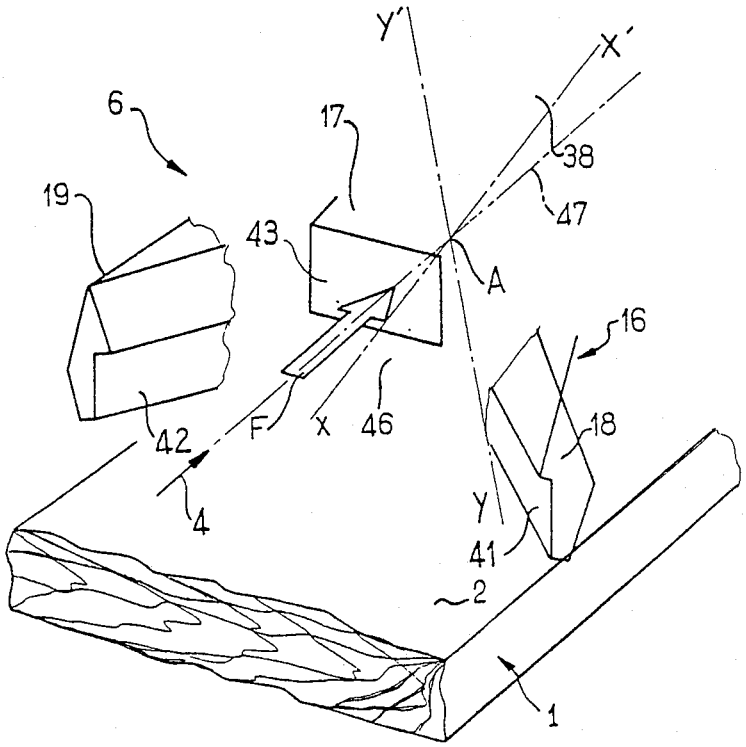
FIG. 7.

SAFETY SKI BINDING

CROSS REFERENCE TO CO-PENDING APPLICATION

U.S. application Ser. No. 683,685 filed Dec. 19, 1985 is directed to safety ski binding have a support zone for supporting the front of a boot above the convergence point of two lines of support around which the binding laterally pivots.

BACKGROUND OF THE INVENTION

1. Field of the Invention

The present invention relates to a ski binding, as well as to a ski provided with such a binding. More specifically, the present invention relates to a binding comprising:

a jaw adapted to receive and retain the front end of a ski boot with respect to a ski. Two lateral wings are provided for this purpose at the rear of jaw. The wings are adapted to grip the boot on both lateral sides thereof;

a support element defining, for the jaw, two frontwardly directed lines of support with respect to the ski, for guiding the lateral pivoting of the jaw. The two lines of support converge upwardly at a point, to define a common plane transverse with respect to the ski, such that lateral pivoting of the jaw with respect to the ski around either one of the lines of support is accompanied by a lifting of the wings of the jaw with respect to the ski; and an elastic energization mechanism which presses the jaw against the support element and biases the jaw elastically against lateral pivoting around the lines of support.

2. Description of Background and Relevant Information

In bindings of the type described above as well as in the description of the binding of the present which will follow, absent any specific mention to the contrary, the relative positions of the various elements of the ski binding and the ski are understood to be relative to the direction of the normal displacement of these elements.

This type of binding is described in French Pat. Nos. 2,517,214; 2,478,476; 2,458,299; 2,419,737; and 2,420,359 belonging to assignee, which are hereby incorporated by reference.

These types of bindings are adapted to retain the front end of the boot on the ski, while the rear end of the boot is retained on the ski by other means. This front abutment is adapted to free the boot by virtue of lateral pivoting of the jaw when the release threshold of the elastic system is reached, for example, in response to excessive torsional forces on the leg. An appropriate adjustment system is also provided for the elastic energization mechanism which permits adjustment of this release threshold of the elastic mechanism.

Such a simple system responds in a entirely satisfactory fashion to a torsional fall which induces torsional movement of the boot. In such an instance, lateral pivoting of the jaw frees the boot due to lateral pivoting of the retention wings. In addition, lateral pivoting of the jaw can also be accompanied by a frontward movement of the jaw with respect to the support element, against the resistance of the elastic energization.

However, it has been discovered that such a binding is inadequate when a torsional fall is combined with a frontward fall. During a frontward fall, that portion of the sole which is directly beneath the front of the foot is pressed downwardly against the ski with a substantial force, thereby creating an appreciable friction between the sole of the boot and the ski which opposes lateral pivoting of the boot and its liberation from the jaw.

As a result, the bindings described above must include a supplementary apparatus to compensate for this increased friction during a frontward and torsional fall.

For example, it has been proposed to attach a plate composed of materials having a low coefficient of friction to the upper surface of the ski. Such plates can be made, for example, of polytetrafluorethylene or polyethylene, but this type of arrangement has not been entirely satisfactory. Thus, manufacturers have attempted to find other solutions to this problem.

Another solution that has been proposed is to place a sensor beneath the front of the boot. This sensor acts on the elastic energization mechanism so as to reduce the bias against lateral pivoting produced by that elastic mechanism and is described in German Offenlegungschrift No. 2,905,837 or French Pat. No. 2,523,837.

In its French Patents and Certificates of Addition to French Pat. Nos. 83 19397; 84 00346; and 84 03664, the assignee of this application has proposed solutions to this problem which use a plate carrying retention means at the rear end of the boot and which support the sole of the boot. The retention means is journalled on the ski and on the jaw to facilitate a lateral pivoting of the jaw in the event of a torsional fall or in the event a frontward fall is combined with a torsional fall. In French Patent Application No. 86 12910 filed Aug. 17, 1984, the assignee of the present application has also proposed the use of a journalled jaw which is journalled to means for elastically resisting lateral pivoting in a manner so as to facilitate such a pivoting when a torsional fall is combined with a frontward fall. These solutions are more effective than the previously mentioned solutions which relied upon a plate composed of a material having a low coefficient of friction, and are safer than systems utilizing sensors which are vulnerable to freezing and mud and are mechanically susceptible to damage.

It has, however, been observed that the more efficient the means provided to facilitate lateral pivoting in case of a frontward fall the more these means are subject to disturbance by a moment or torque which tends to facilitate this pivoting or on the contrary, to hinder it. This effect results from a pressing of the boot frontwardly on the jaw along a force line which is offset with respect to one or the other of the two support lines of the jaw towards the front around which the jaw pivots with respect to the ski. Thus, these means are particularly sensitive to a frontward force imparted by the boot in the event of a frontward fall.

Therefore, there is a need to prevent the appearance of such a moment or torque, particularly when such means for facilitating lateral pivoting of the jaw are provided, so as to thus ensure more perfect control of the efficiency of these means.

SUMMARY OF THE INVENTION

It is therefore, an object of the present invention to provide a safety binding of the type discussed above, which is adapted to free the boot during a torsional and forward fall, as well as to free the boot during a torsional fall alone and which does not generate a torque or moment due to the pressure of the front of the boot on the binding.

The binding which accomplishes these objectives is adapted to releasably hold the front of the ski boot on a ski. The front of the boot designed to be used with such a binding can comprise a front end, which can be spaced from the lateral edges of the boot. The binding comprises a jaw, a support, and a support zone means on the jaw. The jaw is adapted to hold the front end of the boot, and is adapted to laterally pivot in response to pivoting of the boot. The support is positioned upon the ski and comprises two upwardly converging lines of support. The jaw is adapted to laterally pivot around either one of these two upwardly converging lines of support. The support zone means is positioned on the jaw and supports the front end zone of the boot when the boot is held by the jaw. The support zone means comprises means for generating substantially zero torque on the jaw in response to forward pressure of the front end of the boot on the support zone means during a frontward fall. The jaw further comprises a rear portion and two lateral wings, each lateral wing being adapted to grip one of the lateral sides of the boot. The wings can be positioned at the rear portion of the jaw. Also, the invention can comprise such a binding in combination with a ski.

The support zone means is positioned at the rear portion of the jaw between the two lateral wings, and the support zone means is integral with the jaw.

The binding also comprises an elastic energization mechanism, adapted to press the jaw frontwardly against the support. The elastic energization mechanism biases the jaw against lateral pivoting.

The support also comprises a rear portion. The two upwardly converging lines of support are positioned on the rear portion of the support and are frontwardly directed. Furthermore, the jaw and support together comprise means for lifting the jaw when the jaw laterally pivots around the two upwardly converging lines of support.

The upwardly converging lines of support define a common transverse plane with respect to the ski. The upwardly converging lines of support also converge at a convergence point above the ski. Furthermore, the support zone means comprises means for supporting the front end of the boot along a line which substantially intersects this convergence point.

The jaw can experience a moment or torque in response to lateral pressure from the boot against one of the lateral wings. In such an instance, the support zone means further comprises means for generating substantially zero additional torque for laterally pivoting the jaw, in response to forward pressure of the front end of the boot on the support zone means.

In an alternative embodiment, the median level of the support zone means and the median point of mutual contact between the front end of the boot and the support zone means is positioned higher than the convergence point of the two upwardly converging lines of support. In still another embodiment, the median vertical level of the support zone means above the ski and the median point of mutual contact between the front end of the boot and the support zone means is positioned substantially at the same vertical height above the ski as the convergence point of the two lines of support.

In still another alternative embodiment the median vertical level of the support zone means and the median point of mutual contact between the front end of the boot and the support zone means is positioned below the vertical level of the convergence point with respect to the ski. In this embodiment the support zone means is inclined in the rearward direction from the top to the bototm of the support zone means with respect to the upper surface of the ski.

In still another embodiment the median vertical level of the support zone means is positioned above the vertical level of the convergence point. In this embodiment the support zone means is inclined in the frontward direction from the top to the bottom of the support zone means.

The binding further comprises means for facilitating vertical pivoting of the jaw in the event of a combined torsional and frontward fall. In this embodiment the binding is adapted to be used with a boot having a sole comprising a front portion, and an intermediate portion adjacent to this front portion. In this embodiment, the facilitating means comprises a sole support positioned under the sole and on the ski. This sole support comprises means for supporting the intermediate portion of the sole and for raising the front portion of the sole above the ski. The means for supporting the intermediate portion and raising the front portion of the sole comprises a convex zone positioned under the intermediate portion of the sole and a substantially flat zone positioned under the front portion of the sole. In one embodiment, the sole support is affixed with the ski and with the support.

In still another embodiment the jaw further comprises a cut-out portion or recess below the support zone means for receiving the front portion of the sole. In this embodiment, the substantially flat zone is positioned under the cut-out portion and the sole support is positioned beneath the lateral wings of the jaw.

In still another embodiment, the support zone means is positioned at the same vertical level as the upper of the boot. Alternatively, the support zone means can be positioned at the level of the sole of the boot.

In one embodiment, the two upwardly converging lines of support are positioned symmetrically with respect to one another and with respect to the longitudinal plane of symmetry of the ski when the jaw is pressed on both lines of support simultaneously in its rest position. Furthermore, the support zone means is integrally, structurally and functionally symmetrical with respect to the plane of symmetry of the ski when the jaw is supported by and pressed against both lines of support simultaneously.

In still another embodiment, the jaw further comprises means for adjusting the relative positions of the lateral wings and the support zone means. In this embodiment that adjusting means can comprise means for rotating each lateral wing around a separate axis which is substantially parallel to the axis around which the jaw laterally pivots. In this embodiment, the separate axes are positioned symmetrically with respect to the longitudinal plane of symmetry of the ski.

The rotating means can comprise a cap, a cramp, and a journal pin. The cap is positioned toward the front of each lateral wing of the jaw and comprises two spaced-apart elements. The cramp is positioned in the space between the two spaced-apart elements, and the journal pin connects the two spaced-apart elements and the cramp. Each lateral wing is adapted to rotate around an axis defined by the journal pin.

The jaw in this embodiment also comprises an opening therein for receiving the support. The jaw further comprises two shoulders, one on each wing, which are adapted to contact a portion of the boot when the boot is held by the jaw. The jaw also includes a cut-out portion for receiving the sole of the boot. In this embodiment, the rotating means further comprises a first opening in each of the wings, and a pin. The longitudinal axis of this first opening is perpendicular to the plane of symmetry of the ski, and the first opening is positioned above the shoulders and the cut-out portion of the jaw. Furthermore, the first opening is positioned rearward of the opening for the support. The pin engages the first opening, and rotation of the pin rotates the lateral wings around the journal pin. The pin can comprise two end portions. In this embodiment, the rotating means further comprises a second opening in each of the lateral wings connected to the first opening. This second opening is positioned between the exterior of each wing and the first opening. Each second opening is adapted to receive a different end portion of the pin. The longitudinal axes of the first openings in each lateral wing are aligned with each other and the second opening comprises a tapped bore. Each end portion of the pin also comprises a tapped portion complementary to the tapped bore of the second opening, whereby each end portion of the pin is adapted to screwed into each second opening.

The jaw further comprises a body, between the lateral wings. This body comprises a transverse slit therein, which extends forward and behind the longitudinal axis of the first opening. The slit opens toward the support zone means. The slit also comprises a recess extending through and symmetrical with the longitudinal axis of the ski. In addition, the pin further comprises a peripheral groove adapted to engage the recess of the slit. Also, one end portion of the pin further comprises a slit adapted to receive a screwdriver for rotating the pin in the first and second openings. Also provided is a means for preventing spontaneous rotation of the pin in the first and second openings.

The support can also comprise: a base attached to the ski; two upwardly converging projections extending above the base and which comprise the two upwardly converging lines of support; a front portion; and a wing positioned on top of the projections and having a recess therein which is symmetrical with respect to the longitudinal plane of symmetry of the ski.

The jaw can further comprise an opening which opens downwardly and in which the support is received. In this embodiment, the jaw forms a cap on top of the support. In addition, the jaw and support can be monoblocks. Also, the jaw can further comprise two grooves in the opening of the jaw which are adapted to receive the projections of the support therein. In a rest position of the jaw, each projection simultaneously contacts one of the grooves of the jaw.

The jaw can further comprise a screw and a projection in the bottom portion of the opening of the jaw. This projection is positioned between the two grooves and, further, comprises a substantially vertical tapped opening therein adapted to receive the screw, whereby the vertical height of the jaw with respect to the support is varied in response to the screwing of the screw in the projection of the jaw.

The jaw also comprises an upper wall, spaced above the projection of the jaw a greater distance than the vertical height of the wing of the support. This upper wall has an opening therein for receiving the screw. The projection of the jaw is of sufficient dimensions such that the wing of the support is positioned between the projections of the jaw and the upper wall when the projections of the support contact the grooves of the jaw.

The screw can comprise a groove therein, positioned between the upper wall and the projection of the jaw when the screw is completely screwed into the opening of the projection of the jaw. In addition, this groove of the screw engages the recess of the wing of the support when the screw is completely screwed into the opening of the projection of the jaw, whereby the screw is frontwardly and laterally supported.

The jaw can further comprise a tapped opening having a longitudinal axis aligned with the longitudinal axis of the ski when the binding is in a rest position. One end of the tapped opening opens into the opening in the jaw. The other end of the tapped opening opens to the exterior of the jaw at the front thereof. In addition, the tapped opening is adapted to receive the elastic energization mechanism.

The elastic energization mechanism, in turn, comprises a compression spring, an adjusting cap, and a piston. The adjusting cap is positioned at the front end of the tapped opening and the compression spring, and is adapted to be screwed into the tapped opening to adjust the tension of the compression spring. The piston is positioned at the rear end of the compression spring and comprises a rear surface, biased against the front surface of the support, whereby the grooves of the jaw are biased against the projections of the support, and the groove of the screw is biased against the recess of the wing of the support.

In addition, the binding can further comprise means for ensuring the front end of the boot contacts the support zone means whenever the jaw holds the front of the boot. Furthermore, this ensuring means comprises a recess on the rear portion of the jaw for engaging the sole of the boot when the jaw holds the boot.

In addition, that portion of the jaw behind a plane formed by the lines of the support lifts upwardly in response to the lateral pivoting of the jaw around one of the lines of support, and that portion of the jaw in front of the plane formed by the lines of support is displaced downwardly in response to lateral pivoting of the jaw around one of the lines of support. The jaw is configured such that the front portion of the jaw is spaced above the ski when the jaw is in the rest position, to permit downward pivoting of this portion when the jaw pivots around one of the two upwardly converging lines of support.

In still another embodiment, the invention comprises a ski binding adapted to releasably hold the front of a ski boot onto a ski. The front of the boot comprises a front end zone. In one embodiment this front end zone is spaced from the lateral sides of the boot. The binding comprises a jaw, a support, and a means for preventing an increase in the moment experienced by the jaw due to forward pressure of the front end of the boot on the jaw. The jaw is adapted to hold the front of the boot and is adapted to laterally pivot in response to lateral pivoting of the boot. The jaw experiences a moment in response to lateral pressure from the boot against the jaw. The support is mounted on the ski and comprises two upwardly converging lines of support. The jaw is adapted to laterally pivot around either one of these two upwardly converging lines of support.

The preventing means prevents an increase in the moment due to forward pressure of the front end of the boot on the jaw in response to a frontward fall.

In addition, the invention can comprise the binding in combination with the ski. Furthermore, the jaw can further comprise a rear portion and two lateral wings, each lateral wing being adapted to grip one of the lateral sides of the boot. The wings are positioned at the rear portion of the jaw. In addition, the preventing means is positioned at the rear portion of the jaw and between the two lateral wings and is integral with the two wings.

The binding can further comprise an elastic energization mechanism adapted to press the jaw rearwardly against the support. This elastic energization mechanism biases the jaw against lateral pivoting.

This support further comprises a rear portion. The two upwardly converging lines of support are positioned on this rear portion, and the jaw and support together comprise means for lifting the jaw when the jaw laterally pivots around the upwardly converging lines of support.

The upwardly converging lines of support define a common transverse plane with respect to the ski. Furthermore, the upwardly converging lines of support converge at a convergence point. In addition, the preventing means comprises means for supporting the front end of the boot along a force line which substantially intersects this convergence point.

In one embodiment, the preventing means is positioned higher than the convergence point. In this embodiment the preventing means is frontwardly inclined from the top to the bottom of the preventing means.

Furthermore, the boot can further comprise a sole having a front end and a front end zone spaced from the lateral sides of the boot. In this embodiment, each lateral wing comprises a recess adapted to receive the front end of the sole therein.

In another embodiment, the boot can further comprise an upper having a front end. In this embodiment, the preventing means is positioned higher than the recesses and the preventing means comprises means for frontwardly supporting the front end of the upper.

The jaw can further comprise means for adjusting the relative positions of the lateral wings and the support zone means. In addition, the support lines can be positioned symmetrically with respect to one another and with respect to the longitudinal plane of symmetry of the ski. In addition, the preventing means is symmetrical with respect to the plane of symmetry of the ski when the bidning is in a rest position in which the longitudinal axis of the jaw can be substantially parallel to the plane of symmetry of the ski. In addition, the two lines of support can contact the jaw whent he binding is in the rest position, and the binding is symmetrical with respect to the plane of symmetry of the ski when the jaw is supported by both lines of support simultaneously.

BRIEF DESCRIPTION OF THE DRAWINGS

Additional characteristics and advantages of the present invention will become clear from the detailed description which follows, as well as the attached drawings, in which:

FIG. 4 also illustrates the position of the boot during a frontward fall;

FIG. 5 illustrates a partially broken away perspective view along arrow V of FIG. 1, of a portion of the support in which the two upwardly converging lines of support around which the jaw laterally pivots can be seen;

FIG. 6 illustrates a partially broken away perspective view of the jaw taken along arrow V in FIG. 1, wherein grooves can be seen in the jaw which are adapted to receive the upwardly converging projections on the supports;

FIG. 7 is a schematic perspective view of the binding taken in the same direction as FIG. 5, and shows the effect of the force applied frontwardly on the jaw of the binding;

DETAILED DESCRIPTION OF PREFERRED EMBODIMENTS

Figure 1:
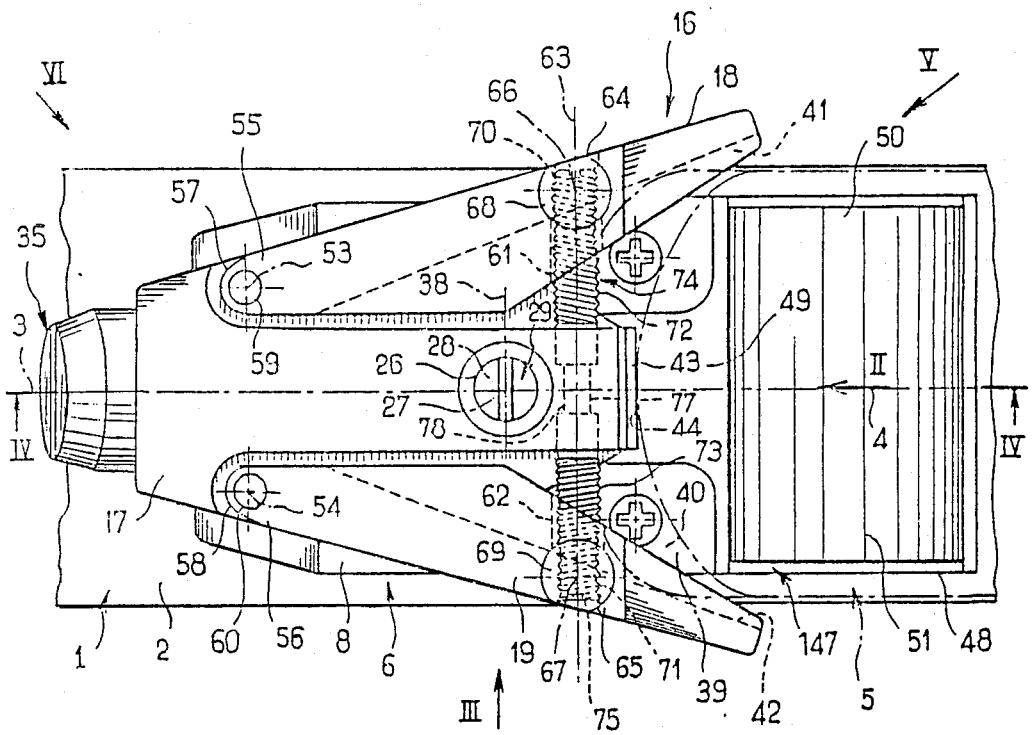
FIG. 1 illustrates a top view of the binding of the present invention in the rest position, i.e., in the absence of any torsional bias or any force directed in a forward direction.

It is an objective of the present invention to prevent the generation of a moment arising from forward pressure of the front end of the boot on the binding, particularly when means of the type discussed above are used, thereby preserving perfect control over the means for increasing the ease of lateral pivoting of the boot.

To accomplish this goal, the binding of the present invention which is of the "front abutment" type previously described, comprises a support zone, integral with the jaw and positioned between its two wings at the rear of the jaw. This support zone on the jaw supports the front-end zone of the boot at the front thereof with respect to the ski along a force line which extends substantially through the convergence point of two frontwardly directed support lines. As a result, when the boot applies a pivoting moment or torque to one of the wings of the jaw so that the jaw pivots around one of the two support lines, an additional pivoting moment is not added by the boot to the jaw to any substantial extent as a result of the pressing of the boot frontwardly against the support zone except to the extent that the front of the boot has been displaced laterally from the convergence point.

In a preferred embodiment, means are also provided to adjust the relative positions of the lateral wings and the support zone. However, during lateral pivoting of the jaw with respect to the ski, the position of the lateral wings and the support remained fixed with respect to one another.

The present invention, further provides such a binding in combination with the ski.

Referring to FIGS. 1–10, the ski is generally designated by reference numeral 1. Ski 1 is shown in its normal utilization position in which upper surface 2 of ski 1 is generally planar and horizontal in the description which follows. Ski 1 also has a longitudinal plane of symmetry 3 which is assumed to be substantially vertical. Plane of symmetry 3 corresponds to the plane of cross-section IV–IV in FIG. 1. Arrow 4 illustrates the reference direction corresponding to the normal direction of displacement of the ski, which is parallel to surface 2 and is positioned along plane 3. This direction of displacement of the ski, which coincides with direction II in FIG. 1, will serve as the reference direction when the terms "frontwardly", "rearwardly", "front," and "rear" appear in the description which follows and plane 3 will serve as a reference when the term "lateral" is used.

Upper surface 2 on ski 1 has a rear binding mounted thereon (not shown) which is adapted to immobilize the rear end of the sole of boot 5 (schematically shown in FIG. 1) with respect to the ski. Front binding 6, which is shown in FIGS. 1–10, is adapted to immobilize to the front portion of boot 5 and the sole of boot 5.

Figure 10:
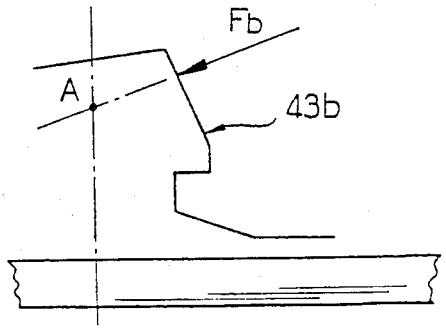
FIG. 10 illustrates a schematic view of an alternative embodiment to FIG. 9.

Binding 6 is of the type described in FIGS. 10 12 of French Pat. No. 2,458,299, the disclosure of which is hereby incorporated by reference. Binding 6 is mounted on ski 1 by support 7 which is clearly seen in FIGS. 4 and 5. Support 7 is similar to the support element described in French Pat. No. 2,458,299.

Support element 7 is preferably a single piece or monoblock formed, for example, by the molding of a metal alloy with a metal base plate 8. Base plate 8 is attached to ski 1 preferably by screws schematically illustrated by axes 9 and 10. As a result, the screws connect support 7 with ski 1 so that support 7 is positioned flat on upper surface 2 of ski 1 and support 7 forms a projection which extends above upper surface 2 of ski 1 in a direction substantially or generally perpendicular to ski 1. Furthermore, support 7 is positioned on ski 1 so that support 7 is symmetrical with respect to the longitudinal plane of symmetry 3 of ski 1.

Figure 4:
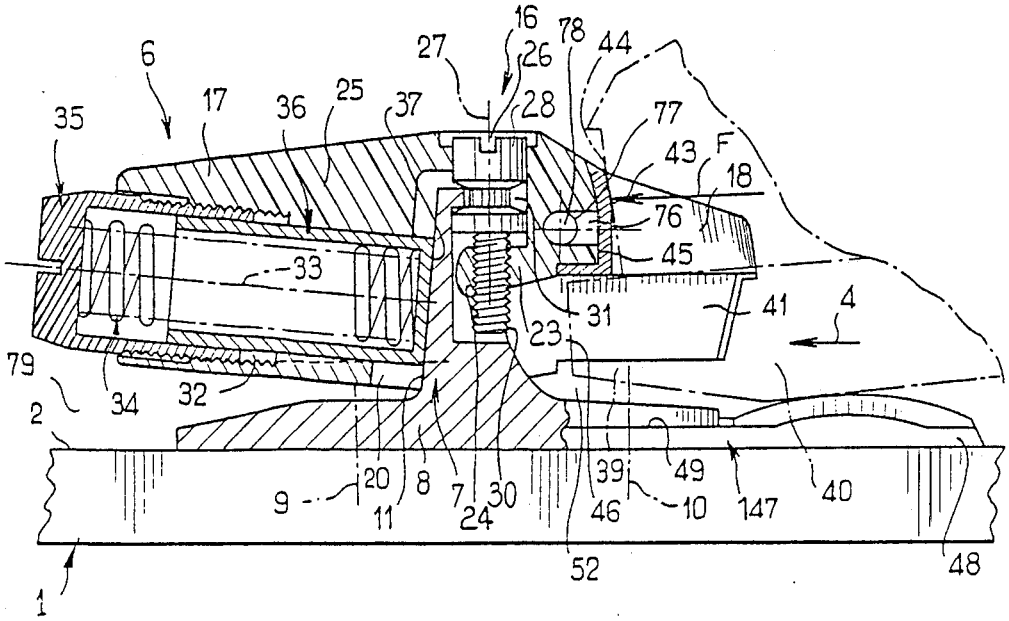
FIG. 4 illustrates a cross sectional view of the binding taken along plane IV—IV of FIG. 1, wherein plane IV—IV defines a longitudinal plane of symmetry for the boot and the binding when the boot is in the rest position.

As is described in French Pat. No. 2,458,299, support 7 comprises a front support surface 11 which is also symmetrical with respect to plane 3 and is substantially or generally perpendicular to surface 2. However, as seen in FIG. 4, surface 11 may be inclined slightly toward the rear. Front surface 11 of support 7 is adapted to contact the elastic energization mechanism which biases binding 6 against lateral pivoting as will be described below.

As seen in FIGS. 5 and 6, support 7 also comprises a base 8 and two projections 12 and 13 positioned at the rear of support 7 and in the immediate vicinity of base 8. Projections 12 and 13 are symmetrical with respect to one another and with respect to plane 3. In addition, support 7 further comprises a wing 14 positioned on top of projections 12 and 13, and in a zone of support 7 furthest from base 8. Wing 14 extends toward the rear, and is parallel to base 8. Furthermore, wing 14 comprises a recess 15 therein which extends symmetrically with respect to plane 3 and which opens toward the rear.

Support 7 is adapted to be capped or topped, as described in French Pat. No. 2,458,299, by a jaw 16. Jaw 16 is also preferably a monoblock which is formed by the molding of a metal alloy or by the molding of a plastic material. In the preferred embodiment seen in FIGS. 1–10, jaw 16 comprises a body 17 and two lateral wings 18 and 19 supported by body 17. The assembly formed by body 17 and wings 18 and 19 functions as one integral unit during the operation of the binding, and permits the adjustment of these elements with respect to each other as will be discussed below.

Body 17 is in the form of an oblong block, which is oblong in direction 4 and is symmetrical with respect to plane of symmetry 3 when the binding is in a rest position. The binding is in its rest position when the longitudinal axis of body 17 is substantially parallel to the longitudinal axis of the ski as is seen in FIG. 1 and/or when body 17 engages projection 12 and 13 simultaneously.

As is seen in FIGS. 4 and 6, body 17 has an internal opening 20 therein which opens downwardly. Support element 7 is engaged in opening 20.

Grooves 21 and 22 are provided at the bottom of opening 20. Grooves 21 and 22 open toward the front, and are adapted to engage rear projections 12 and 13, respectively, of support element 7. In the rest position, the grooves 21 and 22 contact projections 12 and 13 simultaneously. In addition, grooves 21 and 22 occupy positions identical to projections 12 and 13 with respect to plane 3 when the binding is in its rest position. As a result, grooves 21 and 22 are said to be complementary to projections 12 and 13.

Body 17 also comprises a projection 23, positioned at the bottom of opening 20 and which extends frontwardly between grooves 21 and 22. Projection 23 comprises a tapped bore 24. The longitudinal axis of bore 24 is an axis 27 which is substantially vertical and is positioned in plane 3 when the binding is in the rest position. In addition, the top of projection 23 is positioned at an intermediate level between the top and bottom of opening 20.

Projection 23 has sufficient dimensions that when grooves 21 and 22 press frontwardly on projections 12 and 13, respectively, wing 14 is interposed between grooves 21 and 22 and is positioned above projection 23 and occupies a position substantially parallel to upper surface 2 of ski 1 when the binding is in its rest position. Because an upper wall 25 of body 17 is spaced above projection 23 at a height greater than the vertical height of wing 14, there is vertical play between wing 14 and projection 23 and upper wall 25. In addition, upper wall 25 includes an opening 26 through which axis 27 also passes.

The binding further comprises a screw 29 having a head 28 and a threaded shaft 30. Threaded shaft 30 is adapted to be screwed into tapped opening 24 of projection 23. Opening 26 has a sufficient diameter to permit head 28 of screw 29 to pass therethrough along axis 27, but doesnot permit any relative transverse displacement of head 28 with respect to the binding.

As is described in French Pat. No. 2,458,299, head 28 of screw 29 comprises an annular groove 31 positioned between projection 23 and upper wall 25 when the screw 29 is completed screwed into opening 24. Cut-out or recess 15 of wing 14 is adapted to engage groove 31 when binding 16 is mounted on support 7. As a result, head 28 and screw 29 are frontwardly, laterally, upwardly, and downwardly supported with respect to ski 1.

As a result of the above-described structure, the tightening or loosening of screw 29 in tapped opening 24 adjusts the vertical position of body 17 with respect to support 7 and therefore, with respect to upper surface 2 of the ski.

The binding also comprises an elastic energization mechanism which biases grooves 21 and 22 against projections 12 and 13, and which further biases groove 31 of screw 29 against cut-out or recess 15 of support 7. This elastic energization mechanism is adapted to be received in tapped opening 32 in body 17. One end of opening 32 opens into opening 20 while the other end of opening 32 opens to the exterior of the front of body 17. Longitudinal axis 33 of opening 32 is positioned substantially in plane 3 and is substantially perpendicular to surface 11 of support 7.

The elastic energization mechanism comprises a compression spring 34 which is positioned within opening 32 so that the longitudinal axis of spring 34 is aligned with axis 33. The front of spring 34 is supported on a cap 35 which is adapted to be screwed within opening 32 to adjust the tension of spring 34. The rear portion of spring 34 contacts a piston 36 which is slidably mounted along axis 33 and in opening 32. Piston 36 comprises a flat rear surface 37 which is oriented substantially perpendicular to axis 33 and which is biased under the action of spring 34 on front surface 11 of support element 7.

As a result of the pressure of rear surface 37 on front surface 11 of support 7 generated by spring 34, the binding in biased against lateral pivoting away from a stable rest position. However, during a forward fall, for example, a torsional force can be generated which overcomes this bias and laterally pivots the binding away from this rest position against the bias of this elastic system.

As discussed above, jaw 16 also comprises a body 17 and wings 18 and 19. Wings 18 and 19 extend toward the rear with respect to body 17. Furthermore, wings 18 and 19 are symmetrical with respect to plane 3 and with respect to one another when in the rest position. Wing 18 is positioned on the same side of plane 3 as projection 13 and groove 22, and while wing 19 is positioned on the same side of plane 3 as projection 12 and groove 21. As a result, the force exerted by the boot during a torsional fall on lateral wing 18 so as to displace wing 18 away from plane 3 causes a pivoting of the entire jaw assembly 16 (i.e. body 17 and wings 18 and 19) around axis YY'. Axis YY' is defined by the cooperation of projection 13 wirh groove 22, and by the cooperation of groove 31 with recess 15.

Axis YY' is positioned in a plane 38 as is seen in FIG. 7. Plane 38 is substantially perpendicular to plane 3 and is substantially perpendicular to direction 4. Furthermore, plane 38 is oblique with respect to upper surface 2 of the ski.

In an analogous manner, a force exerted on wing 19 so as to displace wing 19 away from plane 3 causes a rotation of the entire jaw 16 around axis XX' as seen in FIG. 7. Axis XX' is defined by the cooperation of projection 12 with groove 21 and the cooperation of groove 31 with cut-out 15. Plane 38 is formed by axes XX' and YY', and therefore, axis XX' is also positioned also in plane 38. Furthermore axis XX' is symmetrical with respect to plane 3 due to the structure of support 7 and body 17.

The two axes XX' and YY' converge at a point A which is positioned generally or substantially on axis 27 at a level which corresponds substantially to the median or average vertical level of groove 31 above upper surface 2 ski 1.

The pivoting described above is known in itself and results in the boot being pressed against one or the other of lateral wings 18 and 19, both in conventional bindings, and the binding of the present invention. To assist this lateral pivoting each lateral wing comprises a shoulder which projects downwardly from each lateral wing. Thus, lateral wing 18 comprises a downwardly projecting shoulder 41 and lateral wing 19 comprises a downwardly projecting shoulder 42. These shoulders also extend toward plane 3, and are positioned to the rear of body 17. The top portion of these shoulders is below the vertical level of point A.

Shoulder 41 is adapted to engage a front-end zone 39 of a sole 40 of boot 5. Analogously, shoulder 42 is also adapted to engage front-end zone 39 of sole 40 of boot 5.

The pivoting of jaw 16 around one of axes XX' and YY' during a torsional fall is accompanied by upward displacement of that portion of lateral wings 18 and 19 and of that portion of body 17 that is positioned behind plane 38. As a result of this upward displacement of the lateral wings the liberation of the sole of the boot from shoulders 41 and 42 is facilitated. Furthermore, the pivoting of jaw 16 around one of axes XX' and YY' is also accompanied by the downward displacement of that portion of lateral wi;ngs 18 and 19 and body 17 in front of plane 38. The downward displacement of this portion of the jaw can occur because this portion of jaw 16 behind plane 38 is spaced above ski 2 by virtue of play 79 which is reserved for this purpose between this portion of the jaw behind plane 38 and base 8 and/or upper surface 2 to the ski.

During lateral pivoting of the boot and binding there is an increase in the bias that the elastic system provides against lateral pivoting of the jaw. More specifically, the force supplied by surface 37 of piston 36 on surface 11 of support 7 increases as a result of the movement of piston 36 toward cap 35, thereby compressing spring 34.

In addition to the elements discussed above, the rear of body 17 illustrated in FIGS. 1–8 also comprises a support zone 43 positioned between lateral wings 18 and 19. Zone 43 faces the rear and is symmetrical with respect to plane 3 when the binding is in its rest position. Zone 43 is adapted to serve as a frontward support for the rear front end zone 44 of boot 5. It should be noted that zone 44 is defined in this embodiment by the front-end zone of the upper of boot 5, but it is also within the scope of the invention to position zone 44 on any other portion of the boot, such as the sole.

Zone 43 is fixed with respect to body 17. Furthermore, zone 43 further comprises a covering or surface 45 having a coating composed of a material having a low coefficient of friction in the zone of contact with zone 44 of the boot.

In the example illustrated in FIGS. 1–8, zone 43 is substantially planar and is substantially perpendicular to direction 4. The median portion of zone 43 is preferably positioned substantially at the vertical level of convergence point A. Furthermore, body 17 further comprises a cut away or recess 46, positioned beneath zone 43. Recess 46 opens toward the rear and opens downwardly so as to engage front-end zone 39 of sole 40. As the result of this engagement of front-end zone 39 of sole 40 with recess of 46, contact between front-end zone 44 of the upper of the boot and support zone 43 is guaranteed, as soon as the boot is placed in the binding.

Thus, when a fall occurs which results in a twisting or torsional action on the leg in combination with a frontward force being exerted on the leg, this frontward force on the leg causes the front-end zone 44 of the boot to exert a force F on support zone 43 as seen in FIG. 7. This force F, is generally oriented substantially in the direction 4, along plane 3. This force F acts along a force line 47 which intersects axes XX', YY' substantially at point A as seen in FIG. 1 when the binding is in its rest position. More specifically, the binding can be constructed so that force F acts along line 47 which precisely intersects point A when the boot and binding are in their rest position before lateral pivoting as shown in FIG. 1, (in which cases no additional torque is provided by force F) or which passes very close to point A when the boot and binding are in their rest position before lateral pivoting so as to produce a substantially zero additional torque on the binding. It should be understood that when the terms "substantially zero torque on the jaw", "substantially zero additional torque", "prevent substantial increase in the moment on the jaw", or "substantially intersects the convergence point" are used, these terms encompass respectively, a sufficiently small torque, a sufficiently small additional torque, a sufficiently small increase in the moment on the jaw, and a sufficiently small distance from the convergence point so as to produce a positive but substantially zero: torque, additional torque, increase in the moment on the jaw, and distance from the convergence point. It should be noted that regardless of the axes (XX' or YY') around which the pivoting of the jaw and body occurs with respect to support 7 due to the torsional component of the fall, the force F applied along force line 47 provides substantially no additional torque thereby having substantially no effect on the pivoting the binding.

Figure 8:
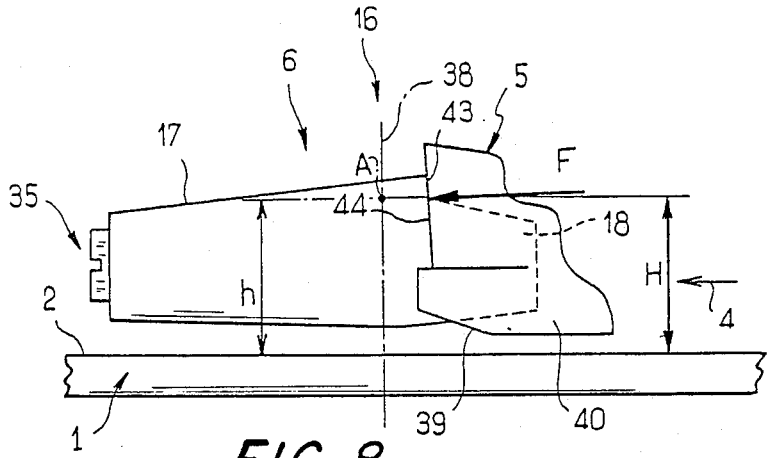
FIG. 8 is a schematic view corresponding approximately to that of FIG. 4, and shows the position of the frontward support zone of the jaw.
Figure 9:
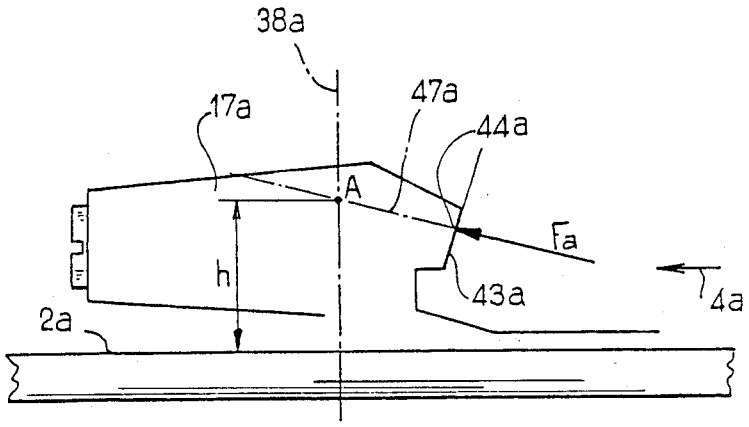
FIG. 9 illustrates a schematic view of an alternative embodiment of the binding of the present invention, seen in FIG. 8.

FIGS. 8 and 9 illustrate different embodiments of the present invention, in which the positions of convergence point A and force line 47, and axes XX' and YY' with respect to force line 47 are different. Thus, for example, in FIG. 8, the median or average vertical level of contact between front-end zone 44 of the upper of the boot and support zone 43 which is referred to as H, is substantially the same as the vertical height of convergence point A, which is referred to as h.

However, it is also within the scope of the invention to position the median or average vertical level of mutual contact between front-end zone 44 of the upper and support zone 43 below height h of convergence point A with respect to surface 2 of ski 1 as seen in FIG. 9. In FIG. 9, 17*a* refers to the body of the binding and 43*a* refers to the support zone; however, the design of this binding is identical in every other respect to the binding described in FIGS. 1–8. In this embodiment, zone 44 is positioned toward the front of the body of the jaw.

Also in this embodiment, support zone 43*a* is substantially perpendicular to the longitudinal plane of symmetry of ski 1. However, in this example, support zone 43*a* is inclined toward the rear with respect to direction 4*a* which corresponds to direction 4. As a result, when a torsional fall is accompanied by a frontward fall, front-end zone 44*a* of the boot, which can for example be on the upper, or on the lower portion of the boot, such as the sole, applies a force to support zone 43*a* having a component Fa which is perpendicular to the support zone in the longitudinal plane of symmetry of the ski. Force Fa, like force F, acts along force line 47*a* which intersects plane 38*a* (defined by axes XX' and YY') between these axes, substantially at their convergence point A.

It is also within the scope of the invention to make the support zone frontwardly oblique, i.e., giving it the shape of a surface 43*b* which is oriented upwardly as shown in FIG. 10. The component of force Fb applied to this surface, perpendicularly thereto, in the case of a frontward fall, would then be directed downwardly and towards the front while substantially passing through convergence point A.

In addition, means can be provided in each embodiment for facilitating lateral pivoting of the jaw during a combined torsional frontward fall by facilitating contact between the front-end zone of the boot and support zone 43, 43*a*, or 43*b*. This means can be of any known type, for example, one of the means disclosed previously. However, as illustrated in FIGS. 1–8, and as could also be provided in the embodiment seen in FIG. 9, this means for facilitating lateral pivoting 147 is positioned to the rear of support zone 43 on upper surface 2 of the ski. Means 147 is a downward support for supporting sole 40 of the boot which is narrowly localized on ski 1. Means 147 comprises two portions: a portion for supporting an intermediate portion of sole 40, spaced from the front of the sole, and a portion adapted to support an overhang portion of the sole position at the front of the sole and also positioned under support zone 43, immediately rearward thereof.

As seen in FIGS. 1–4, means 147 comprises a plate 48 which is integral with upper surface 2 of the ski, and can be integral with base 8 of support element 7. Plate 48 can be formed as a single element with base 8, if desired. Plate 48 comprises a flat front zone 49 positioned beneath support zone 43 and immediately rearwardly thereof. More specifically, substantially flat front zone 49 extends directly beneath cut-out or recess 46 which receives front-end zone 39 of sole 40. Furthermore, zone 49 extends from this recess 46 to substantially the rear edge of wings 18 and 19. Thus, plate 48 is integrally positioned beneath the lower levelof wings 18 and 19.

The second portion of plate 48 is a rear zone 50, which extends upwardly in a convex manner. Rear zone 50 is for example, preferably in the form of a portion of a cylinder of revolution around a generatrix 51 perpendicular to plane 3 so as to form a convex upward projection with respect to front zone 49. Furthermore, zone 50 is positioned immediately behind zone 49. As a result, under normal conditions, of use of the ski, i.e. particularly under conditions other than a fall, zone 50 offers a downward support for sole 40 of boot 5, and specifically for the intermediate portion of sole 40 along generatrix 51 perpendicular to plane 3. In addition, the front-end zone 39 of sole 40 is elevated so that it hangs over front zone 49 of the plate seen in FIGS. 3 and 4. Consequently, front-end zone 39 of sole 40 is spaced from the upper surface 2 of ski 1.

During a frontward fall the boot experiences forces which pivot it upwardly and toward the front. This upward and frontward motion of the boot causes a rolling of sole 40 on convex zone 50, and a pivoting of the front-end zone 39 of sole 40 toward zone 49, so as to reduce the play 52 which initially existed between front-end zone 39 and zone 49 while preserving rectilinear support of zone 39 of the sole on the ski. As a result, even if the pivoting movement of the boot is very small, the front-end zone 44 of the boot is applied to support zone 43 much more effectively than would otherwise be the case, due to flat zone 49 and convex zone 50. Furthermore, this arrangement provides complete stability of the boot while providing a minimum resistance due to friction between the boot and the ski so as to promote lateral pivoting of the boot.

Of course, the embodiments which have just been described comprise only non-limiting embodiments. In particular, it is within the scope of the invention to use any means for mounting body 17 of jaw 16 on support 7. In addition, the precise definition the support of jaw 16 on element 7 and of axes XX' and YY', and the precise embodiment of the elastic system for resisting lateral pivoting of jaw 16 with respect to support 7 may be altered without going beyond the scope of the invention. For example, the means for linking body 17 and support 7 and the elastic system described in French Pat. Nos. 2,517,214; 2,478,476; 2,458,299; 2,419,737; and 2,420,359 belonging to the assignee and the disclosures of which are hereby incorporated by reference, can be used without going beyond the scope of the present invention.

It is also within the scope of the present invention to use a plate supporting the rear binding and the sole of the boot rather than means 147 for facilitating lateral pivoting of the jaw during a combined frontward and torsional fall. This plate is journalled on the ski at the rear of binding 6 and on the binding to the rear of plane 38 (or 38*a*), around respective vertical axes in the manner described in French Pat. No. 84 03664 and Certificates of Addition to French Pat. Nos. 83 19397 and 84 00346 belong to assignee, the disclosure of which are hereby incorporated by reference thereto. It also within the scope of the invention to use another means of facilitating lateral pivoting of the boot, such as means 147 identical to those described in French Patent Application No. 82 20852, the disclosure of which is hereby incorporated by reference thereto.

It is also within the scope of the present invention to provide complementary apparatus which are adapted to render the utilization of the binding which has just been described more practical.

Such an apparatus is means for adjusting the position of lateral wings 18 and 19 with respect to each other and with respect to support zone 43 so as to more precisely adapt the binding to the exact configuration and dimension of different boots having front-end zones 44 and 39 of different shapes and sizes. This means ensures that regardless of the shape and dimensions of the boot used, there is adequate lateral engagement between zone 39 of sole 40 and shoulders 41 and 42, and there is adequate contact between front end zone 44 of the upper of the boot and support zone 43 under normal conditions of use of the ski.

This adjustment means comprises journal axes 53 and 54, around which jaws 18 and 19 are adapted to respectively rotate. Axes 53 and 54 are positioned substantially parallel to axis 27, and are symmetrical with respect to one another and with respect to plane 3 when the binding is in its rest position. Also, axes 53 and 54 are positioned on either lateral side of body 17 and of the front-end zone thereof, as seen in FIG. 1.

This adjustment means also comprises a front portion of each lateral wing facing body 17. More specifically, the front end of lateral wings 18 and 19 respectively, are in the form of caps 55 and 56. Caps 55 and 56 comprise two spaced apart elements, between which is positioned lateral flaps on cramps 57 and 58, respectively. Wings 18 and 19 also respectively comprise axes 53 and 54 via pins 59 and 60 for connecting caps 55 and 56 with cramps 57 and 58 respectively. Furthermore, pins 59 and 60 are journal pins through which journal axes 53 and 54 pass, respectively. As a result, wings 18 and 19 pivot around axes 53 and 54 via pins 59 and 60, respectively.

In addition, the adjustment apparatus further comprises two openings in the rear portion of each wing 18 and 19, to the rear of opening 20. An alignment axis 63 passes through these two openings in wing 18 and 19. Alignment axis 63 is: substantially perpendicular to plane 3; positioned above shoulders 41 and 42; positioned to the rear of opening 20; positioned above cut-out or recess 46; and is positioned immediately in front of surface 45. The first of these openings are openings 61 and 62, which are positioned respectively, in the interior of lateral wings 18 and 19. The second openings are openings 64 and 65 which are also positioned respectively in lateral wings 18 and 19. Openings 64 and 65 are positioned between openings 61 and 62, respectively, and the exterior of lateral wings 18 and 19, respectively. Openings 64 and 65 comprise a cylinder of revolution around axes 66 and 67, respectively. Axes 66 and 67 are substantially perpendicular to alignment axis 63 and substantially parallel to axes 53 and 54. Axes 66 and 67 are also symmetrical with respect to one another and with respect to plane 3 when the binding is in its rest position.

Each of second openings 64 and 65 are adapted to receive journals 68 and 69, respectively, therein. Journals 68 and 69 are adapted to rotate around axes 66 and 67, respectively, within openings 64 and 65, respectively. In addition, openings 64 and 65 are adapted to guide the rotation of journals 68 and 69 therein, respectively. Journals 68 and 69 comprise tapped bores 70 and 71, respectively. Alignment axis 63 is the longitudinal axis of bores 70 and 71 and the longitudinal axes of these bores 70 and 71 is also the longitudinal axis of openings 61 and 62.

Figure 2:
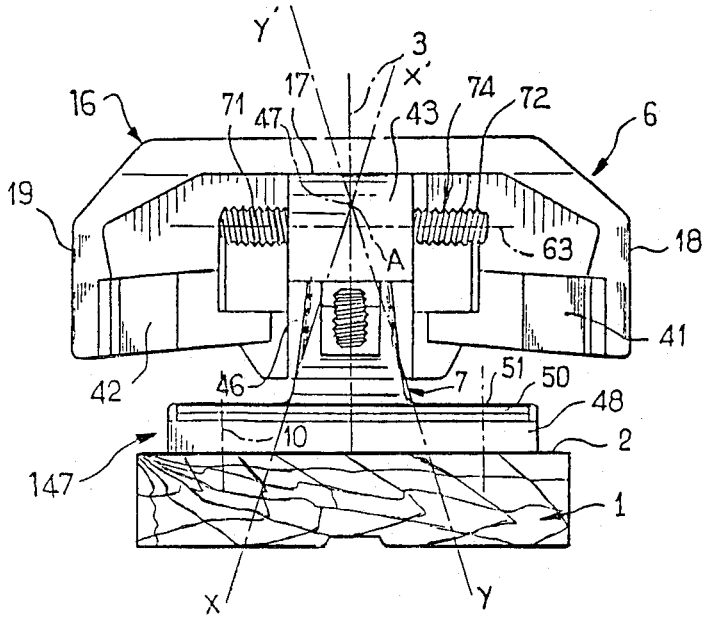
FIG. 2 illustrates a rear view of the binding along arrow II of FIG. 1.
Figure 3:
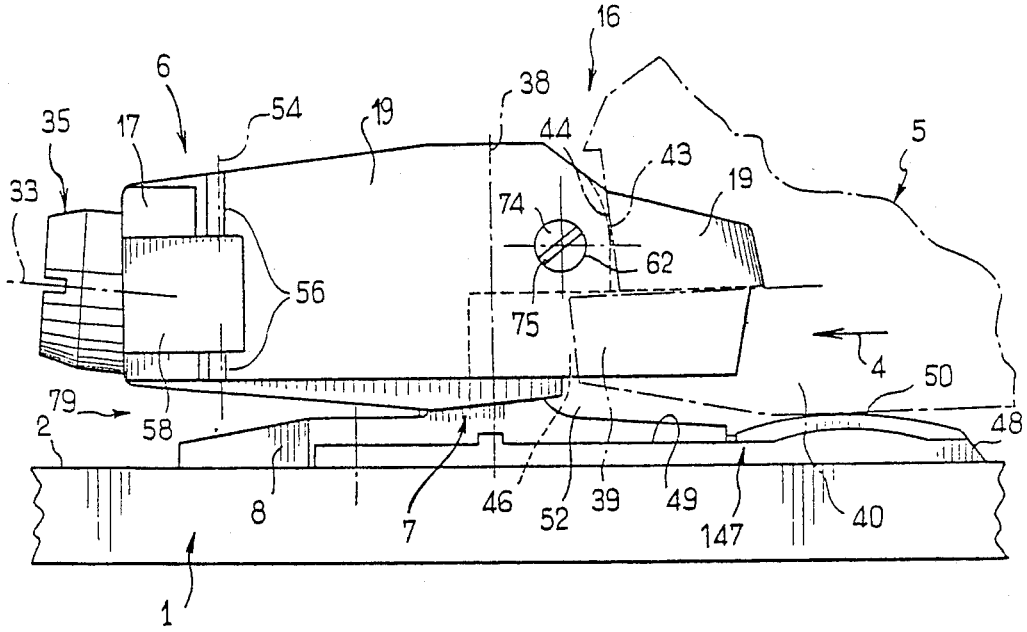
FIG. 3 illustrates a side view of the binding along arrow III of FIG. 1.

Tapped bores 70 and 71 have threads which are oriented in opposite directions with respect to each other (i.e. inverse threads) as may be seen in FIGS. 1 and 2. Tapped bore 70 and 71 are adapted to receive an end zone 72 or 73, respectively, of a pin 74. End zone 72 and 73 of pin 74 are threaded in a complimentary manner to bores 70 and 71 so that each end zone 72 and 73 of pin 74 can be screwed in bores 70 and 71, respectively. When this is done, the longitudinal axis of pin 74 coincides with axis 63. In addition, pin 74 has, at one of its ends, a slot 75 which is adapted to receive a screwdriver. In the embodiment seen in FIG. 1, slot 75 is positioned within journal 69 of wing 19.

As can be seen in FIG. 1, pin 74 is adapted to extend from wing 18, through body 17 to wing 19 via bores 61 and 62, which provide play transverse to axis 63, thereby permitting rotation ofpin 74 around axis 63. As a result, body 17 must comprise an opening to accommodate pin 74. This opening is a slit 76, which transverses body 17 on both sides thereof along axis 63. Furthermore, a central plane which passes through the center of slit 76 includes axis 63 and is substantially perpendicular to axes 53 and 54. In addition, slit 76 opens toward surface 45 where it is closed by support 43 as seen in FIG. 4, to allow engagement of pin 74 for the assembly of the apparatus.

Pin 74 also comprises a peripheral groove 77, positioned at substantially its midlength, in the zone situated within slot 66. Groove 77 is adapted to engage a recess 78 provided in slot 76 at the intersection of groove 77 with plane 3. Furthermore, recess 78 extends symmetrically on both sides of plane 3 when the binding is in its rest position.

The binding assures the immobilization of pin 74 vis-a-vis body 17 along axis 63 by virtue of the engagement of pin 74 with tapped bores 70 and 71. In addition, the free displacement of pin 74 in the rearward direction through slot 76 is also impossible by virtue of the engagement of pin 74 with journals 68 and 69 of lateral wings 18 and 19. However, a slight displacement of pin 74 in slot 76 is possible along the median plane thereof in the forward or rearward direction. Furthermore, pin 74 can be rotated around axis 63 as well with respect to journals 69 and 70. This can be accomplished by introducing a screwdriver into slot 75 to rotate pin 74. The rotation of pin 74 causes lateral wings 18 and 19 to move toward or away from each other, depending upon whether the user rotates the screwdriver in slot 75 in one direction or the other. As a result, the relative positions of shoulders 41 and 42 on the front-end zone 39 of sole 40 and the relative position of shoulders with respect to support 43 and front-end zone 44 of the upper of the boot can be changed while preserving the symmetrical position wings of 18 and 19 with respect to plane 3.

Of course, it is also within the scope of the invention to provide means for the preventing spontaneous rotation of pin 74. For example, one can select an appropriate pitch of the threading of pin 74 and of the tapping of the journal 68 and 69 while taking into account the material of which each of these elements is composed, so as to prevent the spontaneous rotation of pin 74. In addition, any other means known to those skilled in the art can be used for this purpose.

Finally, although the invention has been described with reference to particular means materials and embodiments, it is to be understood the invention is not limited to the particulars disclosed and extends to all equivalents within the scope of the claims.

What is claimed is:

1. A ski binding adapted to releasably hold a front of a ski boot on a ski, wherein said front of said boot comprises a front end, wherein said binding comprises:

(a) a jaw adapted to hold said front end of said boot and adapted to laterally pivot in response to lateral pivoting of said boot, wherein said jaw experiences a moment in response to lateral pressure from said boot against said jaw;

(b) a support mounted on said ski, wherein said support comprises two upwardly converging lines of support, wherein said jaw is adapted to laterally pivot around either of one of said upwardly converging lines of support; and (c) means for preventing a substantial increase in said moment experienced by said jaw due to forward pressure of said front end of said boot on said jaw, wherein said upwardly converging lines of support define a common transverse plane with respect to said ski, wherein said upwardly converging lines of support converge at a convergence point, and wherein said preventing means comprises means for supporting said front end zone of said boot along a force line which substantially intersects said convergence point.

2. A ski binding adapted to releasably holdthe front of a ski boot on a ski, wherein said front of said boot comprises a front end, wherein said binding comprises:

(a) a jaw adapted to hold said front end of said boot and adapted to laterally pivot in response in pivoting of said boot;

(b) a support on said ski, wherein said support comprises two upwardly converging lines of support, wherein said jaw is adapted to laterally pivot around either one of said two upwardly converging lines of support; and (c) a support zone means on said jaw, for supporting said front end of said boot when said front of said boot is held by said jaw, wherein said support zone means comprises means for generating substantially zero torque on said jaw in response to forward pressure of said front end of said boot on said support zone means, wherein said boot has two lateral sides and wherein said jaw further comprises a rear portion and two lateral wings, each lateral wing adapted to grip one of said lateral sides of said boot, wherein said wings are positioned at said rear portion of said jaw, wherein said jaw further comprises means for adjusting the relative positions of said lateral wings and said support zone means, wherein said adjusting means comprises means for rotating each lateral wing, wherein said rotating means comprises:

a first opening in each of said wings;

a pin, engaging said first opening, wherein rotation of said pin in said first opening rotates said lateral wings, wherein said jaw further comprises a body, between said lateral wings, wherein said body comprises a transverse slit therein, extending forward and behind the longitudinal axis of said first opening, wherein said slit opens toward said support zone means, wherein said slit comprises a recess extending through the longitudinal axis of said ski, wherein said pin further comprises a peripheral groove adapted to engage said recess of said slit.

3. The binding defined by claim 2 wherein said rotating means comprises means for rotating each lateral wing around separate axes substantially parallel to the axis around which the jaw laterally pivots, wherein said separate axes are positioned symmetrically with respect to the longitudinal plane of symmetry of said ski.

4. The binding defined by claim 3 wherein said jaw further comprises: an opening therein for receiving said support; two shoulders, one on each wing for contacting a portion of said boot when said boot is held by said jaw; and a cut-out portion for receiving a sole of said boot, wherein the longitudinal axis of said first opening is positioned above said shoulders and said cut-out portion of said jaw and rearward of said opening for said support.

5. The binding defined by claim 2, wherein said pin comprises two end portions, wherein said rotation means further comprises:

a second opening, in each of said lateral wings, connected to said first opening, wherein said second opening is positioned between the exterior of said lateral wing and said first opening, wherein each second opening is adapted to receive a different end portion of said pin, wherein the longitudinal axes of said first openings in each lateral wing are aligned with each other, and wherein each second opening comprises a tapped bore and each end portion of said pin comprises a tapped portion complementary to said tapped bore of said second opening, whereby each end portion of said pin is adapted to be screwed into each second opening.

* * * * *

UNITED STATES PATENT AND TRADEMARK OFFICE

CERTIFICATE OF CORRECTION

PATENT NO. : 4,763,908

DATED : August 16, 1988

INVENTOR(S) : Jean-Pierre DIMIER

It is certified that error appears in the above-identified patent and that said Letters Patent is hereby corrected as shown below:

At column 1, line 58, change "a" to ——an—— after "in".
At column 4, line 4, change "bototm" to ——bottom——.
At column 7, line 48, change "bidning" to ——binding——.
At column 7, line 51, change "whent he" to ——when the——.
At column 9, line 18, change "1012 to ——10-12——.
At column 10, line 47, change "doesnot" to ——does not——.
At column 10, line 52, change "completed" to ——completely——.
At column 11, line 39, change "wirh" to ——with——.
At column 11, line 60, insert ——of—— after "2".
At column 12, line 18, change "wi;ngs" to ——wings——.
At column 12, line 21, change "2" to ——1——.
At column 12, line 56, delete "of" before "46".
At column 14, line 30, change "levelof" to ——level of——.
At column 15, line 21, insert ——is—— after "it".
At column 15, line 67, change "wing" to ——wings——.
At column 16, line 26, change "axes" to ——axis——.
At column 16, line 32, change "bore" to ——bores——.
At column 16, line 33, change both occurrences of "zone" to ——zones——.
At column 16, line 45, change "ofpin" to ——of pin——.
At column 17, line 17, change "the preventing" to ——preventing the ——.
At column 17, line 55 (claim 2, line 1), change "holdthe" to ——hold the——.

UNITED STATES PATENT AND TRADEMARK OFFICE

CERTIFICATE OF CORRECTION

PATENT NO. : 4,763,908

DATED : August 16, 1988

INVENTOR(S) : Jean-Pierre Dimier

It is certified that error appears in the above-identified patent and that said Letters Patent is hereby corrected as shown below:

At column 17, line 59 (claim 2, line 5), change "in" to --to-- after "response".

Signed and Sealed this

Eighteenth Day of February, 1992

*Attest:*

HARRY F. MANBECK, JR.

*Attesting Officer*

*Commissioner of Patents and Trademarks*